US010612786B2

(12) United States Patent
Semerad et al.

(10) Patent No.: US 10,612,786 B2
(45) Date of Patent: Apr. 7, 2020

(54) DUEL-FUEL FIREPLACE APPARATUS

(71) Applicant: Michael Aaron Semerad, Chattaroy, WA (US)

(72) Inventors: Michael Aaron Semerad, Chattaroy, WA (US); Nickolas James Alexander, Spokane, WA (US)

(73) Assignee: Michael Aaron Semerad, Chattaroy, WA (US)

( * ) Notice: Subject to any disclaimer, the term of this patent is extended or adjusted under 35 U.S.C. 154(b) by 197 days.

(21) Appl. No.: 15/913,791

(22) Filed: Mar. 6, 2018

(65) Prior Publication Data

US 2019/0277503 A1 Sep. 12, 2019

(51) Int. Cl.

| | |
|---|---|
| ***F24B 1/18*** | (2006.01) |
| ***F23D 23/00*** | (2006.01) |
| ***F24B 1/181*** | (2006.01) |
| ***F24B 1/191*** | (2006.01) |
| ***F24B 1/187*** | (2006.01) |

(52) U.S. Cl.

CPC ..... *F24B 1/1802* (2013.01); *F23D 23/00* (2013.01); *F24B 1/181* (2013.01); *F24B 1/187* (2013.01); *F24B 1/191* (2013.01); *F23D 2208/00* (2013.01); *F23D 2900/21004* (2013.01); *F23N 2239/02* (2020.01); *F23N 2239/04* (2020.01)

(58) Field of Classification Search

CPC ..... F24B 1/1802; F24B 1/187; F24B 1/191; F24B 1/181; F24B 1/1952; F24B 1/198; F23B 2700/023; F23B 10/00; F23D 23/00; F23D 2900/21004; F23D 2208/00; F24C 3/006; F24C 1/06; F24C 11/00; F23N 2039/04; F23N 2039/02

USPC ..... 126/500, 511, 512

See application file for complete search history.

(56) References Cited

U.S. PATENT DOCUMENTS

| | | | | | |
|---|---|---|---|---|---|
| 984,598 | A * | 2/1911 | Pendray | F24B 1/18 | 126/511 |
| 2,476,542 | A * | 7/1949 | Gauss | F24B 1/191 | 312/204 |
| 5,007,404 | A * | 4/1991 | Hall | F23N 10/214 | 110/214 |
| 5,179,933 | A * | 1/1993 | McCrillis | F23N 5/022 | 110/212 |
| 6,895,958 | B1 * | 5/2005 | Komosky | F24B 1/182 | 126/25 A |
| 2011/0220090 | A1 * | 9/2011 | Atemboski | F24B 1/006 | 126/500 |
| 2013/0092150 | A1 * | 4/2013 | Halverson | F24C 3/002 | 126/523 |

(Continued)

*Primary Examiner* — Grant Moubry
*Assistant Examiner* — Rabeeul I Zuberi
(74) *Attorney, Agent, or Firm* — SBMC

(57) ABSTRACT

A duel-fuel fireplace apparatus is described. In one example, an apparatus includes an enclosure having a door disposed thereon and a wood burning compartment disposed within the enclosure. The wood burning compartment has an insulated housing configured to support temperatures associated with burning of wood within the wood burning compartment. A gas burning compartment is also disposed within the enclosure and has a gas burner disposed therein. A mechanism including a motor is configured to cause movement between a first mode in which the wood burning compartment is viewable through the door and a second mode in which the gas burning compartment is viewable through the door.

19 Claims, 17 Drawing Sheets

(56) References Cited

U.S. PATENT DOCUMENTS

| | | | | |
|---|---|---|---|---|
| 2015/0267922 | A1* | 9/2015 | Lu | F24C 7/004<br>219/218 |
| 2019/0277504 | A1 | 9/2019 | Semerad et al. | |

* cited by examiner

400

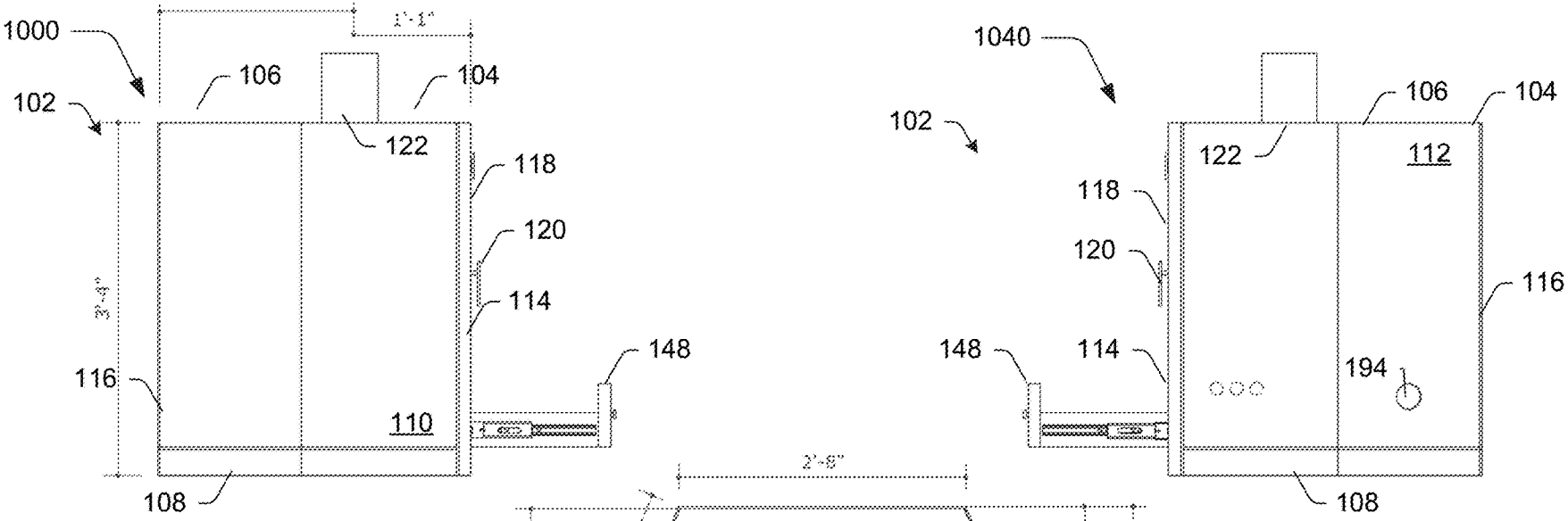
Fig. 10A
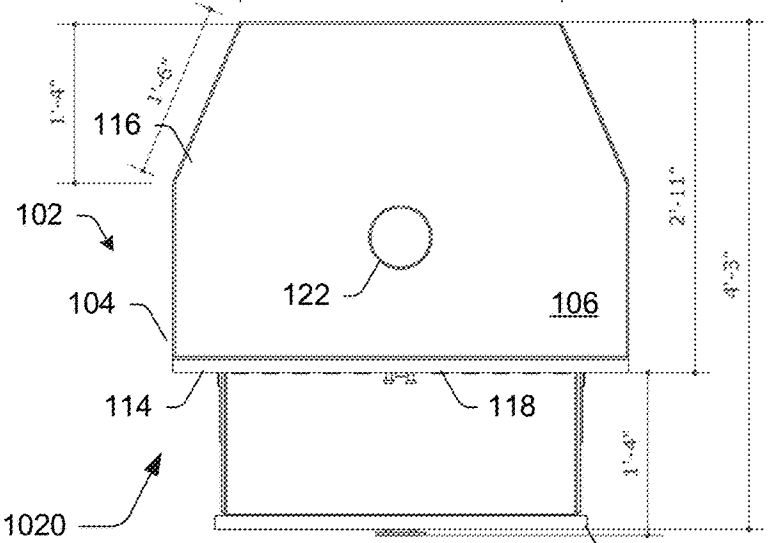
Fig. 10B
Fig. 10C

DUEL-FUEL FIREPLACE APPARATUS

BACKGROUND

Fireplaces are relied upon not for just heat and warmth, but also provide comfort to users in both commercial and residential settings. Increasing regulations and conventional fireplace configurations, however, have forced users to make an either/or choice between gas and wood burning fireplaces.

Users, for example, may choose a gas burning fireplace for the convenience of "just pushing a button" to start a fire and clean up. On the other hand, other users may choose a wood burning fireplace for realism, making s'mores, availability of wood, and a desire for more traditional aesthetics. In both instances, however, the users are forced to choose either one of these options, but not both, which is limiting.

SUMMARY

A duel-fuel fireplace apparatus is described that overcomes the limitations of conventional fireplaces. In one example, an apparatus includes an enclosure having a door disposed thereon and a wood burning compartment disposed within the enclosure. The wood burning compartment has an insulated housing configured to support temperatures associated with burning of wood within the wood burning compartment. A gas burning compartment is also disposed within the enclosure and has a gas burner disposed therein. A mechanism including a motor is configured to cause movement between a first mode in which the wood burning compartment is viewable through the door and a second mode in which the gas burning compartment is viewable through the door.

In an additional example, an apparatus includes an enclosure, a door disposed on the enclosure, and a carousel mounted to the enclosure via a spindle to support rotational movement of the carousel within and in relation to the enclosure. The carousel includes a wood burning compartment having an insulated housing configured to support temperatures associated with burning of wood within the wood burning compartment. The carousel also includes a gas burning compartment, separate from the wood burning compartment, having a gas burner disposed therein. A mechanism including a motor is configured to cause movement of the carousel between a first mode in which the wood burning compartment is viewable through the door and a second mode in which the gas burning compartment is viewable through the door.

In a further example, an apparatus includes an enclosure, a door disposed on the enclosure, and a carousel mounted to the enclosure via a spindle to support rotational movement of the carousel within and in relation to the enclosure. The carousel includes a wood burning compartment and a gas burning compartment. The wood burning compartment has an insulated housing configured to support temperatures associated with burning of wood within the wood burning compartment. The gas burning compartment has a gas burner disposed therein. The gas burning compartment is separated from the wood burning compartment by an insulated wall. A mechanism including a motor is configured to cause the rotational movement of the carousel.

This Summary introduces a selection of concepts in a simplified form that are further described below in the Detailed Description. As such, this Summary is not intended to identify essential features of the claimed subject matter, nor is it intended to be used as an aid in determining the scope of the claimed subject matter.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

FIGS. 10A, 10B, and 10C depict a side, top, and opposing side view of the fireplace apparatus of FIG. 7.

DETAILED DESCRIPTION

Overview

Figure 1:
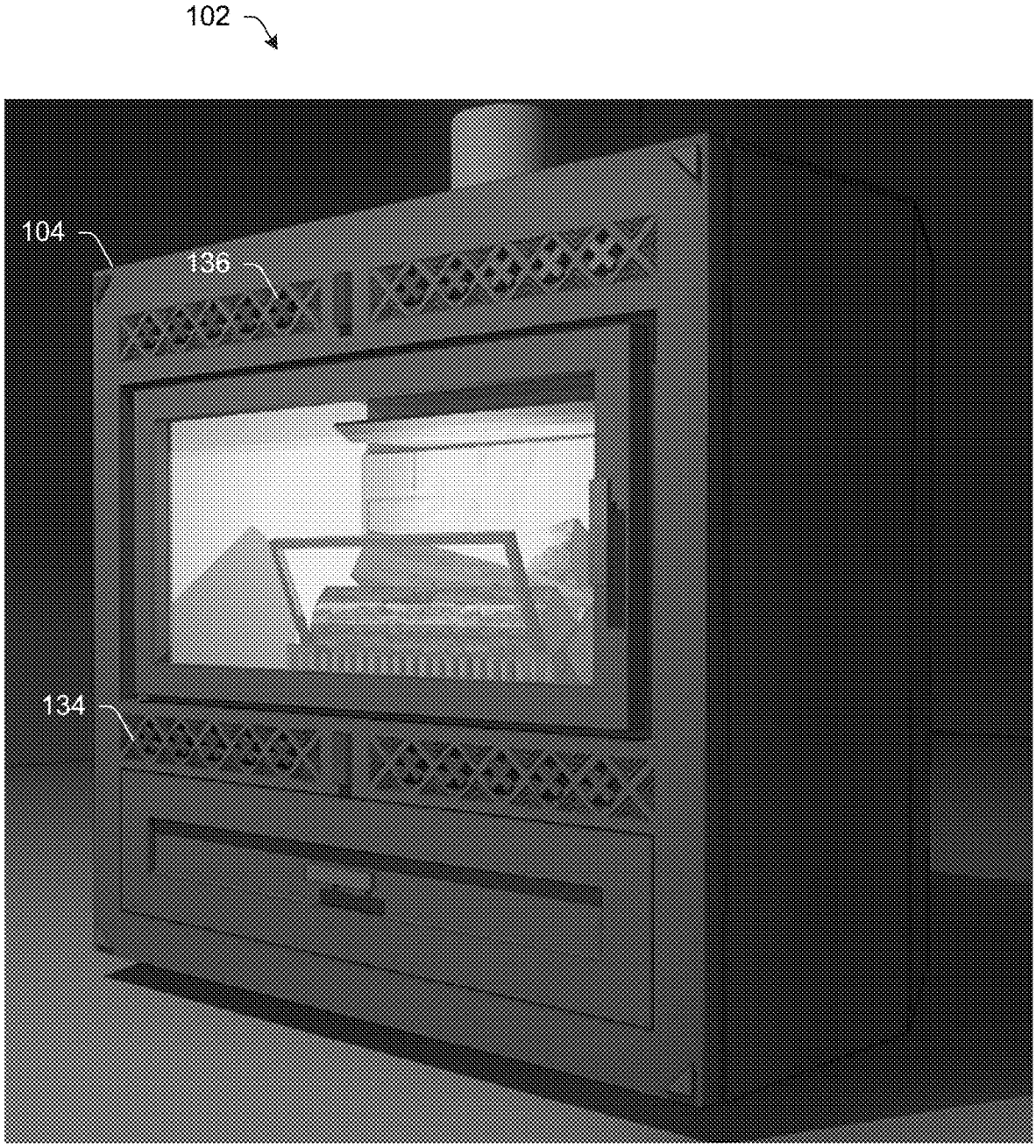
FIG. 1 is an illustration of an environment in an example implementation that is operable to employ dual-fuel fireplace techniques described herein.

Conventional fireplaces, as previously described, require users to make a choice between gas and wood. Although a fireplace has been developed by Kombifire® (See www.kombifire.com), this fireplace requires significant amounts of manual steps to reconfigure between gas and wood burning options, including recessing the gas burner, covering the burner manually with a tray, and then placing the wood fire on top, which is messy, inconvenient, and potentially unsafe in the open configurations.

Accordingly, a duel-fuel fireplace apparatus is described that overcomes the limitations of conventional fireplaces. To do so, the apparatus includes an enclosure with a door, e.g., a glass door with gaskets. In an implementation, a removable screen is disposed in front of the door to protect from injury. The door, for instance, may be configured according to a single or dual configuration, and has a locking mechanism to manually secure the doors to the enclosure, e.g., directly in a single door configuration or indirectly by locking to each other in a dual configuration. The duel-fuel fireplace apparatus may be configured for decorator and/or heating purposes.

A wood burning compartment is disposed within the enclosure. The wood burning compartment has an insulated housing configured to support temperatures associated with burning wood, e.g., over a thousand degrees. This may be implemented in a variety of ways, such as through use of fire brick, Vermiculite, and so forth. A gas burning compartment is also included within the enclosure that has a gas burner disposed therein. Configuration of the wood and gas burning compartments may assume a variety of configurations.

In one such example, the wood and gas burning compartment are included, separately, on a carousel. The carousel is configured to support rotational movement. In a first example, the rotational movement is about an axis that is generally parallel to a base of the enclosure and/or a surface on which the enclosure is placed. Further discussion of this example may be found in a corresponding section and is described in relation to FIGS. 2-6. In a second example, the rotation movement of the carousel is about an axis that is generally perpendicular to the base of the enclosure. Further discussion of this example may be found in a corresponding section and is described in relation to FIGS. 7-11.

In another example, the gas burning compartment supports movement that is generally straight (e.g., through sliding) "up" away from a base and "down" toward the base. In this example, the gas burning compartment is thus disposed within the first burning compartment. Horizontal motions are also contemplated. Further discussion of this example may be found in a corresponding section and is described in relation to FIGS. 12-17.

In each of these examples, a mechanism including a motor is configured to cause movement between a first mode in which the wood burning compartment is visible through the door and a second mode in which the gas burning compartment is visible through the door. This may be performed based on the configuration, e.g., carousel, sliding movement, and so forth. In this way, a user may simply and easily switch between modes through use of the mechanism (e.g., by "pushing a button") without undergoing the manual steps of conventional techniques. Other advantages are also described in greater detail in the following sections, including self-cleaning, ability to heat surrounding through use of a convection fan, gas-assisted lighting for the wood burning compartment (e.g., electronic IPI ignition or millivolt which may include a lighter code or safety pilot system), rack on which utensils may be braced to place consumables proximal to a fire in the fire burning compartment, and so forth.

Fireplace Apparatus

FIGS. 1-17 depict an example is an illustration of a fireplace apparatus 102. In each of the examples, the fireplace apparatus 102 includes an enclosure 104 that is configured for mounting within a residential or commercial structure, e.g., within a wood or metal studded support structure within a house or office. The enclosure 104 has a top portion 106 and a base portion 108, on which, the enclosure 105 is configured to rest on a surface. The enclosure 104 also includes first and second opposing sides 110, 112, e.g., a "left" and "right" side when facing the enclosure 104. The first and second opposing sides 110, 112 each include respective first and second portions forming an angle from a larger front side 114 (e.g., three feet ten inches) to a smaller back side 116 (e.g., two feet, eight and three-quarters inches).

The enclosure 104 also includes a door 118 having a handle 120. In the examples of FIGS. 1-6 the door 118 is formed as a single unified unit and the handle 120 is configured to mechanically engage and lock to the enclosure 104 directly. In the examples of FIGS. 7-10C the door 118 is formed as two pieces. In each of these examples, the door 118 includes a transparent portion, through which, a user may view a fire disposed within the enclosure 104, e.g., tempered and heat resistant glass.

The enclosure 104 further includes a vent pipe 122, e.g., a six inch vent pipe, that is configured to vent gases formed as part of combustion, whether wood or gas based. The enclosure 104, for instance, may include a sealed combustion area 124 spaced apart from an outer mounting area 126. Accordingly, gases generated as part of combustion within the sealed combustion area 124 are configured to be deflected by a deflector 128 to push gasses and particulates toward a catalytic combustor 130. The catalytic combustor 130 is configured to complete burning of the gasses and catch particulates and thus complies with environmental regulations.

Further, this double walled example may be used to heat the surroundings, e.g., a residential or commercial space in which the fireplace apparatus 102 is disposed. The enclosure 104, for instance, may include a convection fan 132 that may cause air to push around the sealed combustion area 124 by passing in through a lower vent 134 and out through an upper vent 136, or just through an upper vent 136, alone. In this way, heat may be efficiently transferred from around the sealed combustion area 124 to a surrounding area of the fireplace apparatus 102.

The fireplace apparatus 102 also includes a wood burning compartment 138, a gas burning compartment 140, and a mechanism 142 to cause movement between a first mode in which the wood burning compartment 138 is positioned for viewing through the door 118 and a second mode in which the gas burning compartment 140 is viewable through the door 118. This may be implemented in a variety of different ways. In a first example, a carousel 144 is used that supports vertical rotation, an example of which is described in a corresponding section and shown in FIGS. 2-6. In a second example, a carousel 144 is also used that support horizontal rotation, an example of which is described in a corresponding section and shown in FIGS. 7-11. In a third example, translational motion along an axis is supported, an example of which is described in a corresponding section and shown in relation to FIGS. 12-17.

Fireplace Apparatus Having Carousel with Vertical Rotation

Figure 2:
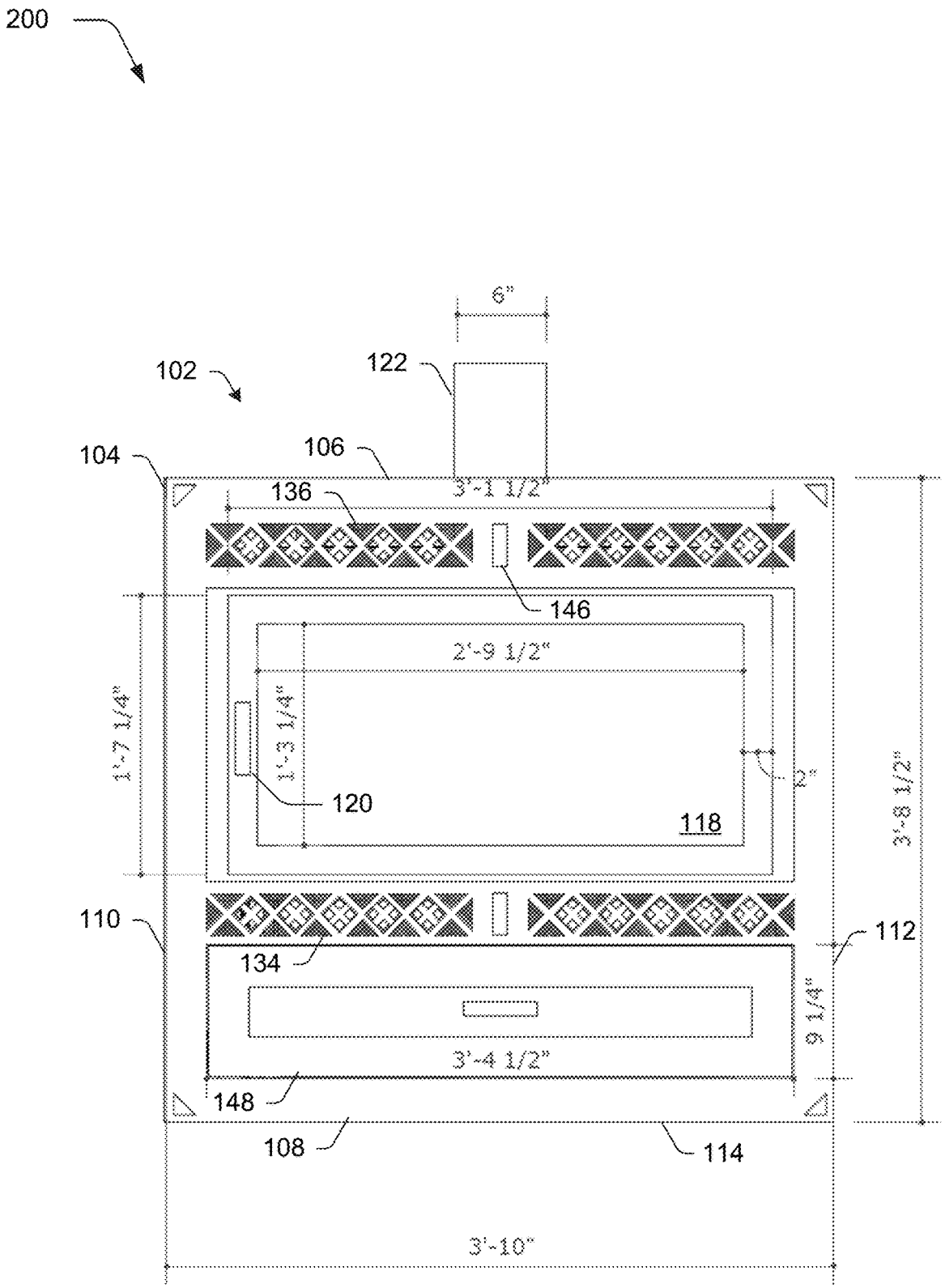
FIG. 2 depicts an example implementation in which the fireplace apparatus support vertical rotational movement to support a wood burning mode and a gas burning mode.

Beginning now with the example 200 of FIG. 2, a front view of the fireplace apparatus 102 is shown. The enclosure 104 includes a door 118 that is at least partially transparent such that a fire burning within the enclosure 104 is viewable by a user. A bypass damper control 146 is included that is configured to control opening and closing of a damper in relation to a vent pipe 122 disposed at a top portion 106 of the enclosure 104. Upper and lower vents 136, 134 are configured as metal cut outs that permit the venting of air around the sealed combustion area 124 as previously described. Either one of the lower vents 134 or a drawer 148 are configured to permit access (e.g., via a hinge or sliding) to gas and electrical controls to control the lighting of a fire, operation of a fan, and so forth.

Figure 3:
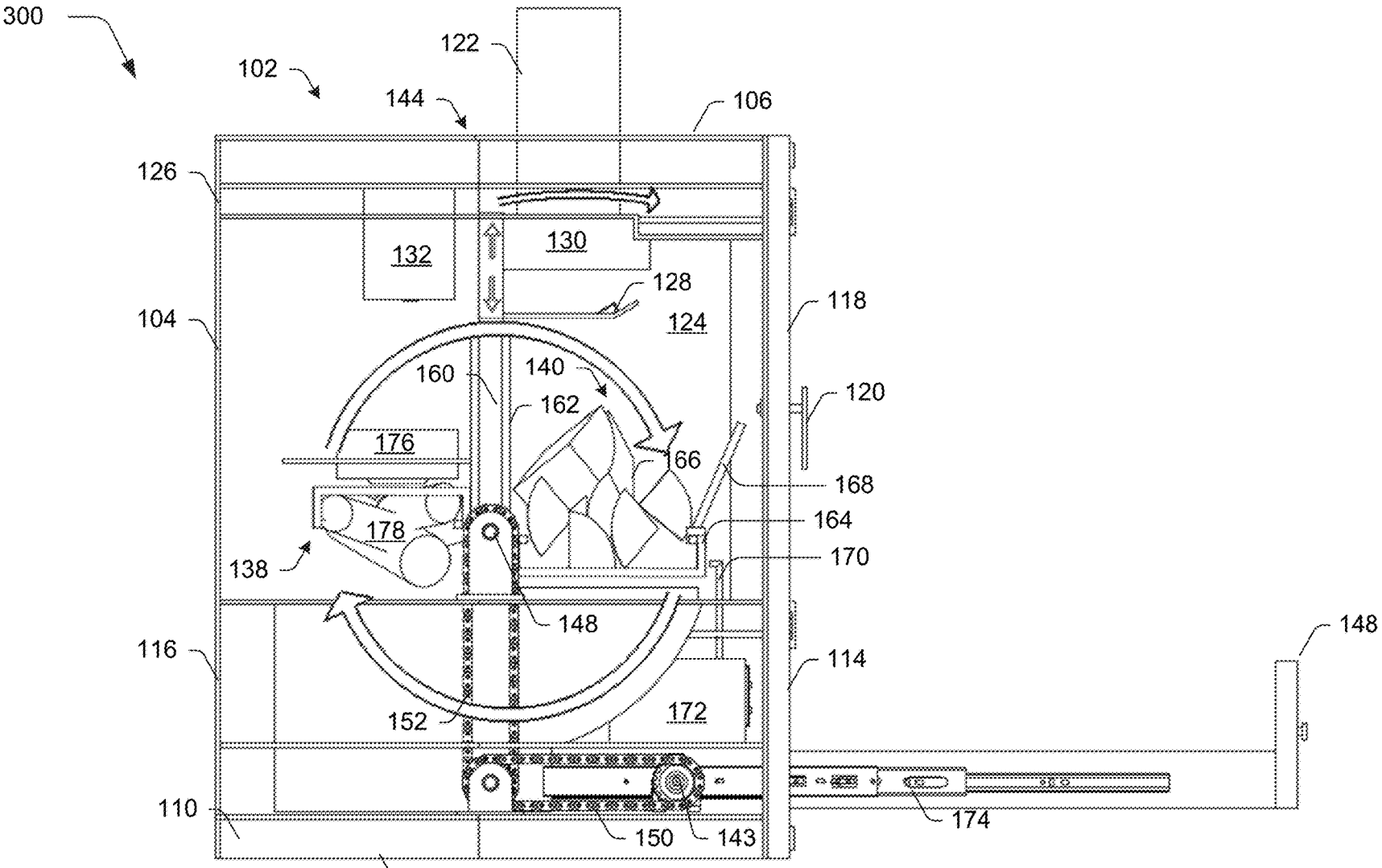
FIG. 3 depicts a side cut-away view of the fireplace apparatus of FIG. 2.

FIG. 3 depicts a side view of an example 300 the carousel 146 from the first opposing side 110. The carousel 146 includes a spindle 148 that is configured to support rotation of the carousel 146 about an axis, which is this instance is substantially parallel to a base 108 of the enclosure 104 and front 114 of the enclosure 104. As illustrated through the user of arrows in FIG. 3, this supports vertical rotational movement of the carousel 146.

The rotational movement is powered through use of a mechanism 142 having a motor 143 that provides the motive force, e.g., an electric motor. The mechanism 142 in this example includes first and second chain and gear systems 150, 152 which may be employed for both strength as well as to limit heat transfer. Other examples are also contemplated, including hydraulics, use of heat-resistant belt and pulley systems, and so forth.

The spindle 148 is disposed within an insulated wall 160, on which, an insulating material 162 such as firebrick, Vermiculite, and so forth is disposed to support temperatures within the wood burning side 124 associated with the burning of wood, e.g., over one thousand degrees. The insulated wall 160, for instance, may be formed as an insulated steel tube barrier wall with a Vermiculite facing.

The wood burning compartment 138 further includes a rack 164 that is configured to support wood 166 (e.g., logs having a length of over six inches) over a floor of the compartment, e.g., such that ashes may fall through the rack 164. The rack 164 further includes a rest 168 that is configured as a rest for a cooking utensil to be disposed thereon while in proximity to a fire within the wood burning compartment 138. The rest 168, for instance, may be configured to rest a fork, stick, or other utensil to cook food items such as marshmallows for S'mores, hotdogs, and so forth.

A fire starter 170 is communicatively coupled to a control box 172 that is gas powered and electronically controlled to a start a flame to initiate the burning of the wood 166 logs, e.g., via user input received from a remote control. In the illustrated example, the fire starter 170 is configured apart from the carousel 144 and thus remains stationary during the movement of the carousel 144.

The drawer 148 in this example is configured to support sliding movement through use of telescoping drawer guides 174 (e.g., soft close drawer guides). Opening of the drawer 146 provides access to the control box 172 in this example. The drawer 146 also serves as a collection area 188 to collect ashes formed in the wood burning compartment 138. For example, rotational movement of the wood burning compartment 138 causes ashes collected in the wood burning compartment 138 to fall downward along an ash chute 186 into the collection area 188 of the drawer 146 when closed. A user may then easily open the drawer to collect the ashes as needed. The drawer 146, for instance, may include a removable tray that may be "lifted out" from the drawer 146 for disposal of the ashes. The drawer 148 may also include a separate compartment 190 configured to hold utensils, pokers, and so forth.

The gas burning compartment 140 includes a gas burner 176 and an object 178 mounted thereto (e.g., mounted directly to a base of the gas burning compartment 140) that is configured to be heated directly by a gas fire from the gas burner 176. The gas burner 176, for instance, may be configured to burn propane, natural gas, and so on. A flame resulting from combustion of this gas by the gas burner 176 is made visible to a user and causes the object 178 to be heated, such as decorative ceramic logs, rocks, and so forth. In this way, the gas burner 176 and object 178 result in a visually-pleasing aesthetic and support use as a source of heat, e.g., through use of the convection fan 132.

Figure 4:
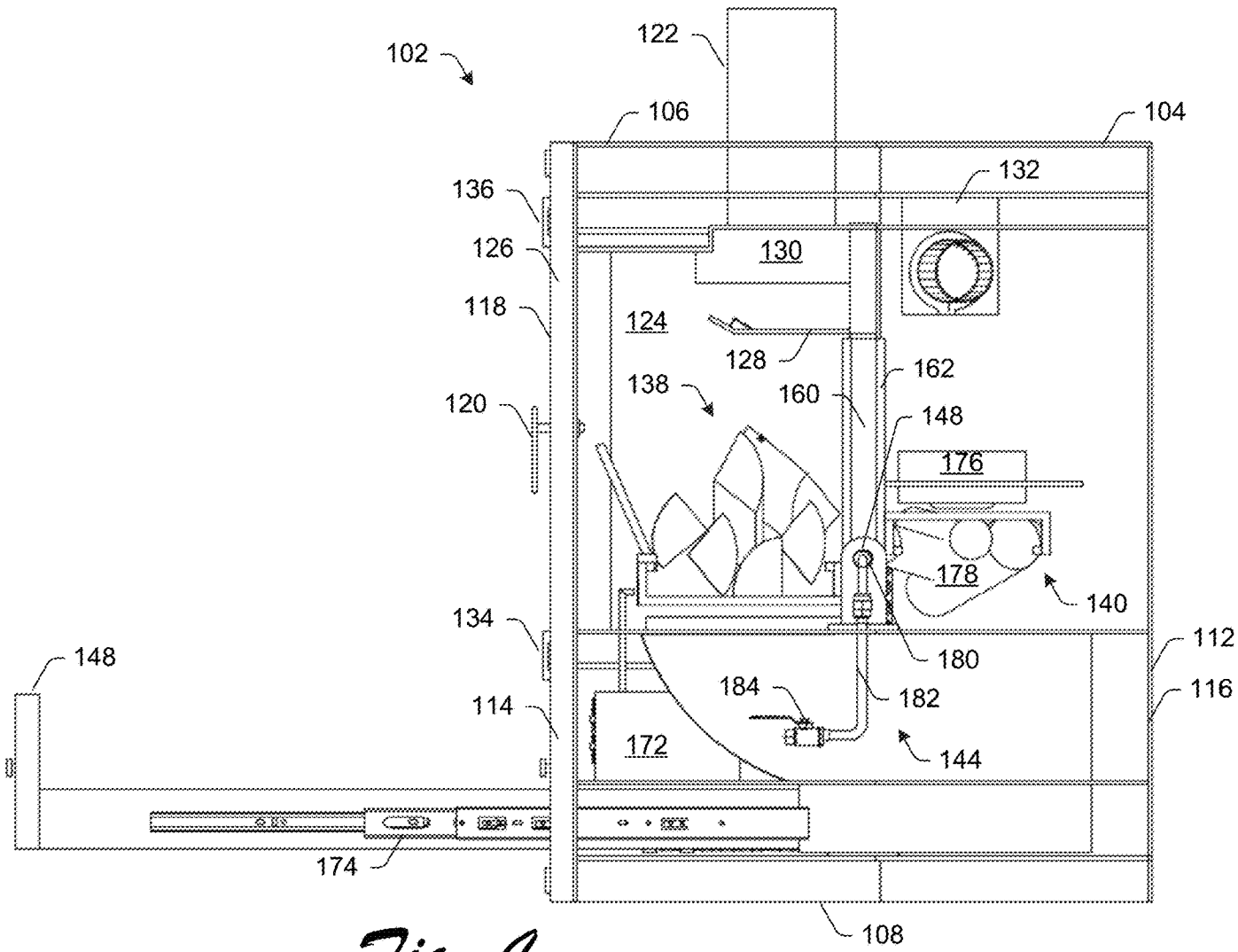
FIG. 4 depicts an opposing side cut-away view of the fireplace apparatus of FIG. 3.

FIG. 4 depicts a side view of an example 400 of the carousel 144 from the second opposing side 112. In this example, a first gas line is connected the gas burner 176 through the spindle to a rotating gas coupler 180 to a second gas line 182 having a gas shut off value 184. In this way, gas may be transferred through the spindle 148 while being insulated by insulation 172 of the insulating wall 170.

Figure 5C:
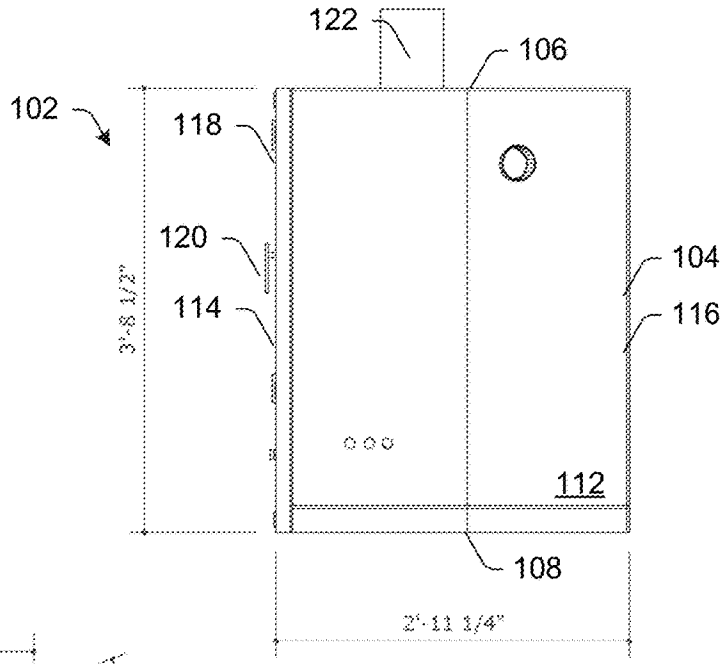
FIGS. 5A, 5B, and 5C depict a side, top, and opposing side view of the fireplace apparatus of FIG. 2.
Figure 5B:
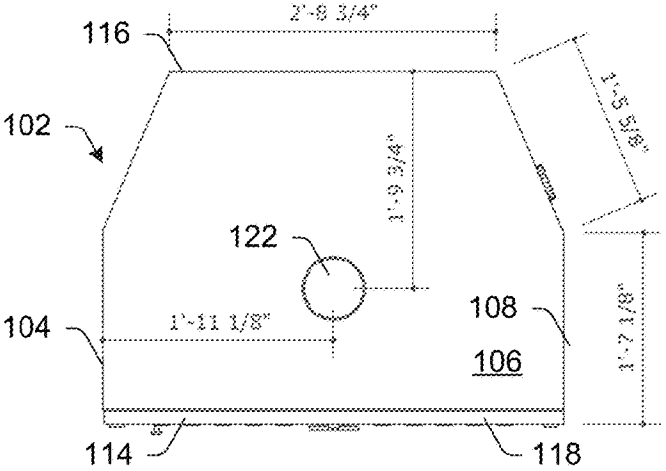
Figure 5A:
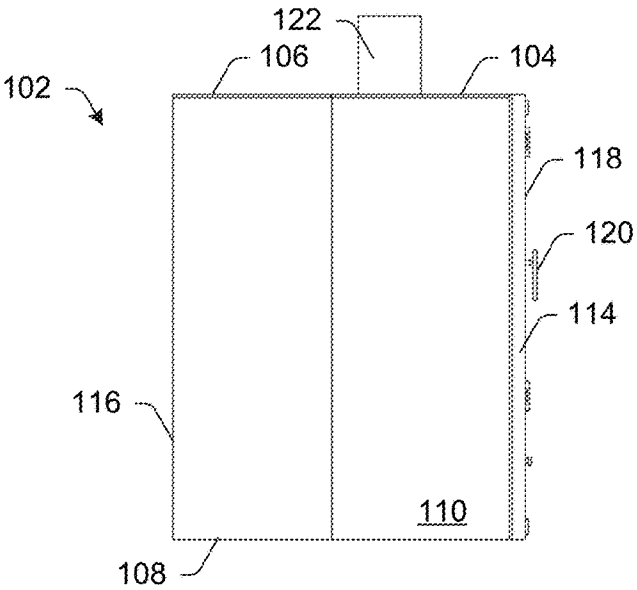

FIG. 5A depicts a side view of the enclosure 104 from the first opposing side 110. FIG. 5B depicts a top view of the enclosure from the top portion 106. FIG. 5C depicts a side view of the enclosure 104 from the second opposing side 112.

Figure 6:
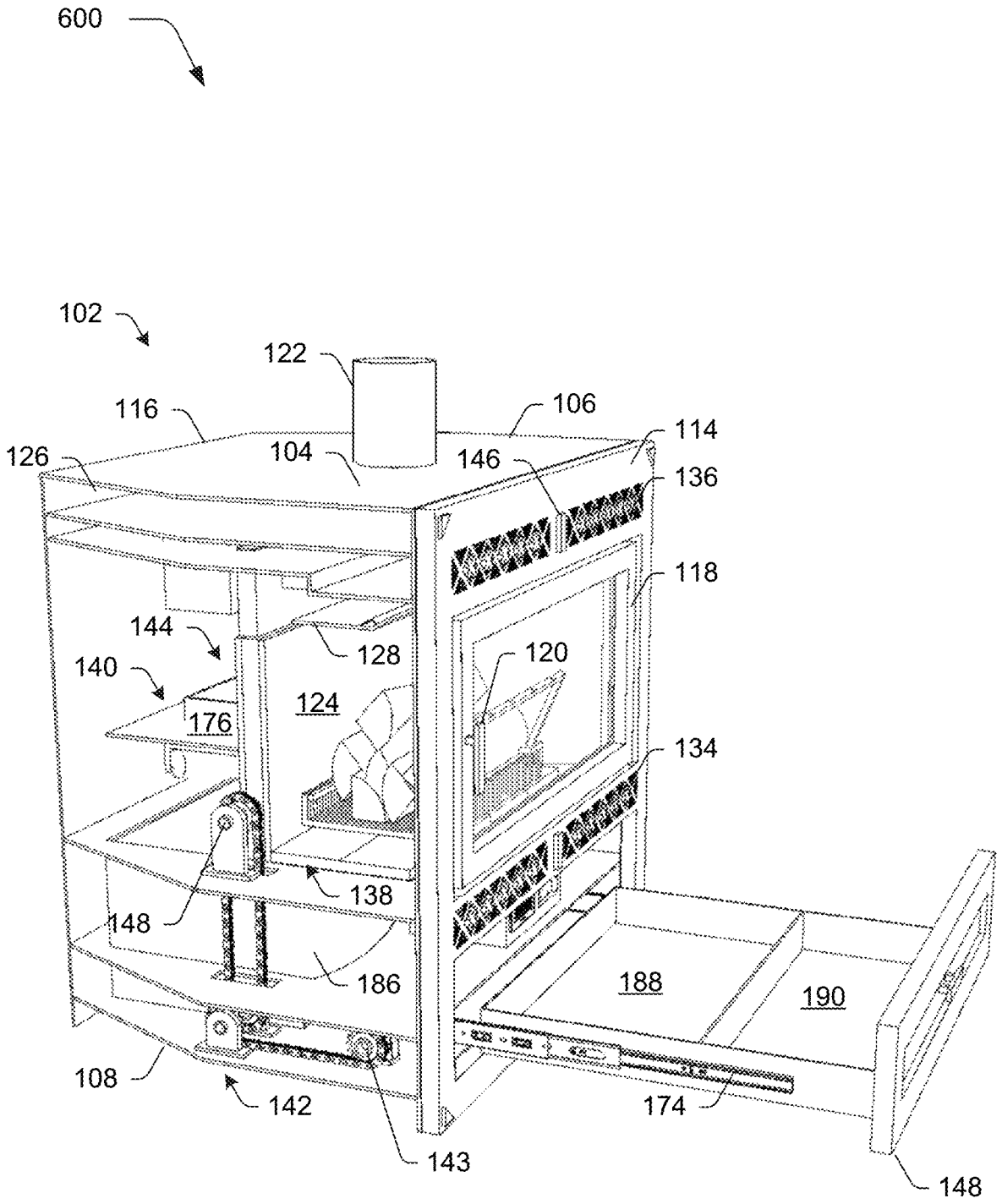
FIG. 6 depicts a perspective cut-away view of the fireplace apparatus of FIG. 2.

FIG. 6 depicts a perspective cut-away view 600 of the fireplace apparatus 102. An ash chute 186, as previously described, is configured to direct ashes formed in the wood burning compartment 138 to the collection area 188 of the drawer 148, when closed. In this example, the rotational movement of the carousel 144 cause the ashes to drop downward along the ash chute 186 and for forced into the collection area 118. These ashes may then be emptied from the collection area 188 by sliding out the drawer 148.

Thus, in this example a user may press a button, which causes the control unit 172 to initiate the motor 143 of the mechanism 142 to cause the carousel 144 to rotate. This may be used to switch from a first mode in which the wood burning compartment 138 is viewable through the door 118 and a second mode in which the gas burning compartment 140 is viewable through the door 118. In this way, a user may quickly choose which type of fuel to burn in the fireplace apparatus 102, and may make the change in seconds with the hassles of conventional manual techniques. Other examples are also contemplated, including horizontal rotational movement as further described in the following section.

Fireplace Apparatus Having Carousel with Horizontal Rotation

Figure 7:
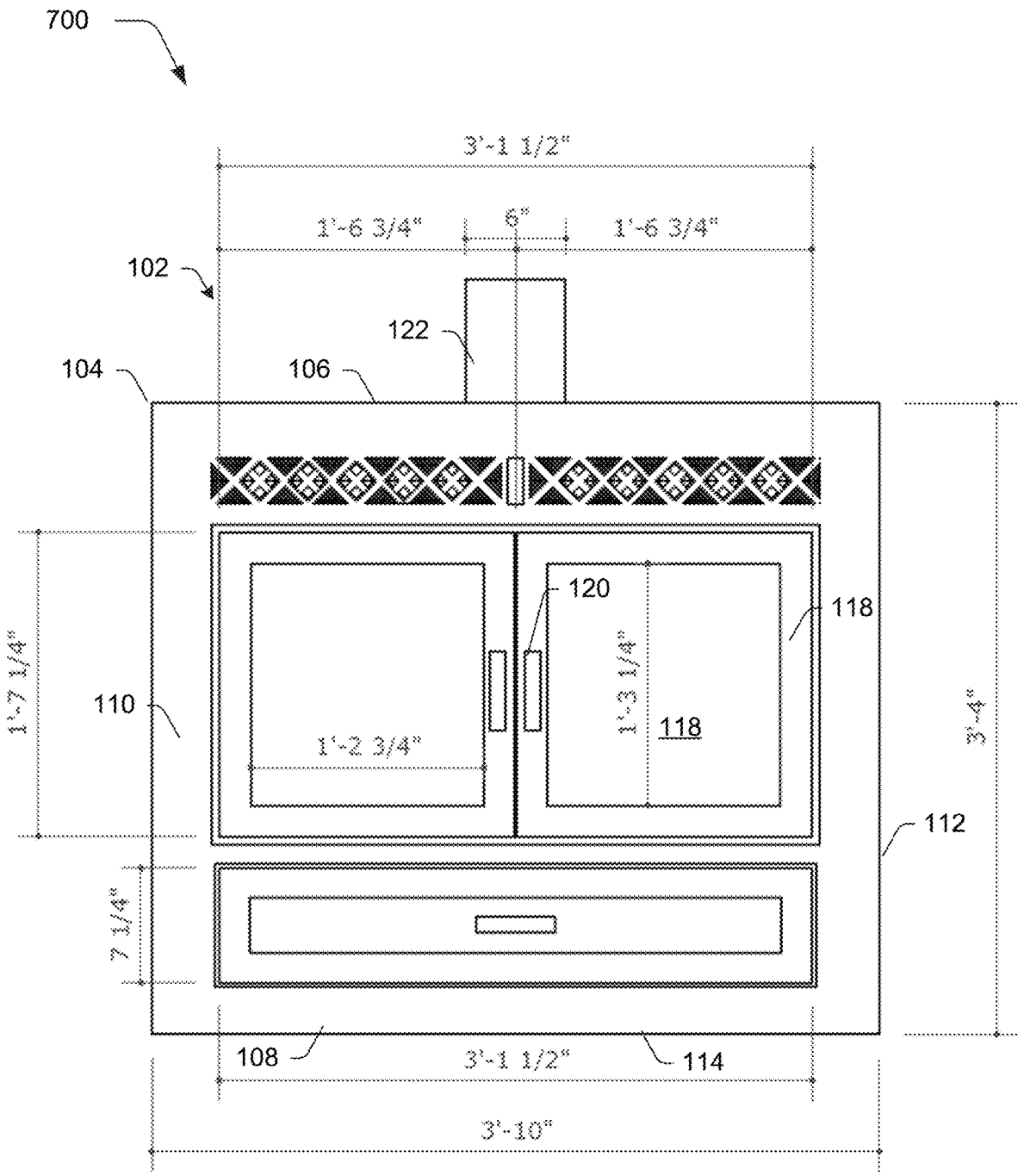
FIG. 7 depicts an example implementation in which the fireplace apparatus support horizontal rotational movement to support a wood burning mode and a gas burning mode.

FIGS. 7-11 depict examples 700, 800, 850, 900, 1000, 1010, 1020, 1100 of the carousel 144 as supporting horizontal rotational movement. As shown in FIG. 7, the door 118 includes a transparent portion such that a person may view an interior of the fire enclosure 104, and more particularly the wood burning compartment 138 or the gas burning compartment 140. The door 118 also includes a handle 120 as part of a two part assembly that lock to each other, thereby securing the door 118 to the enclosure 104.

Figure 8B:
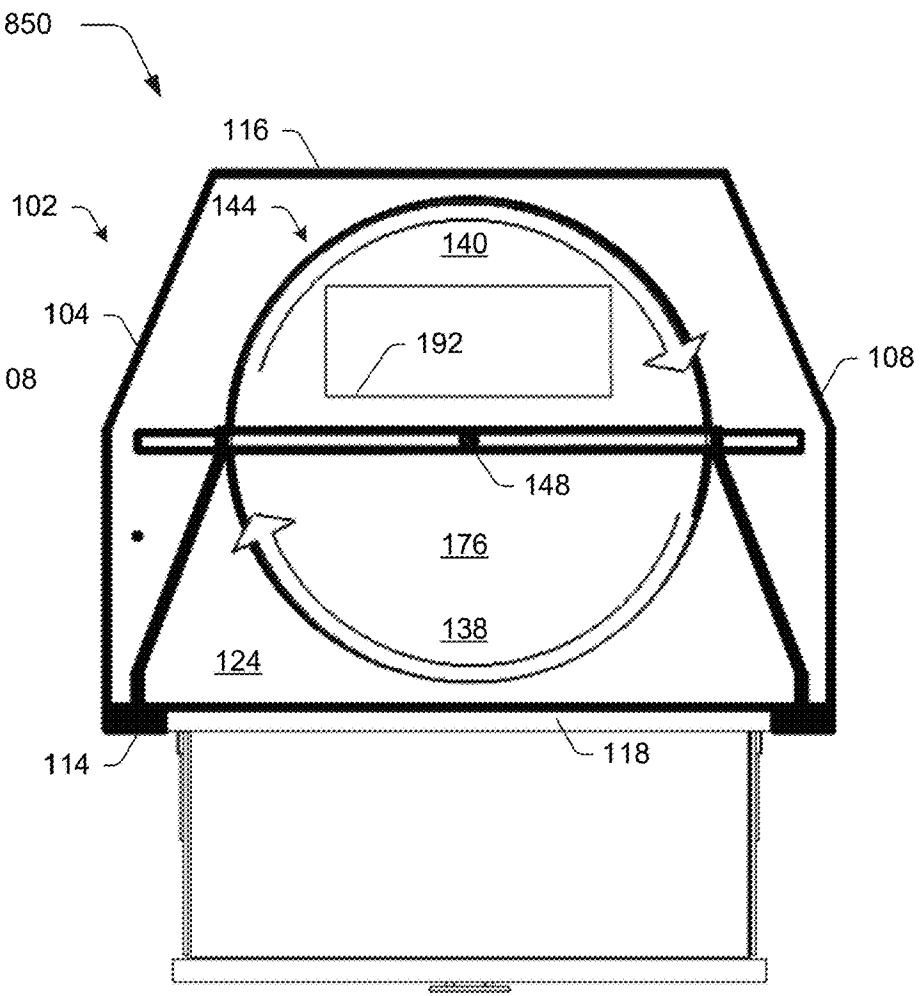
FIGS. 8A and 8B is a top cut-away view illustrating rotational movement of a carousel of the fireplace apparatus of FIG. 7.
Figure 8A:
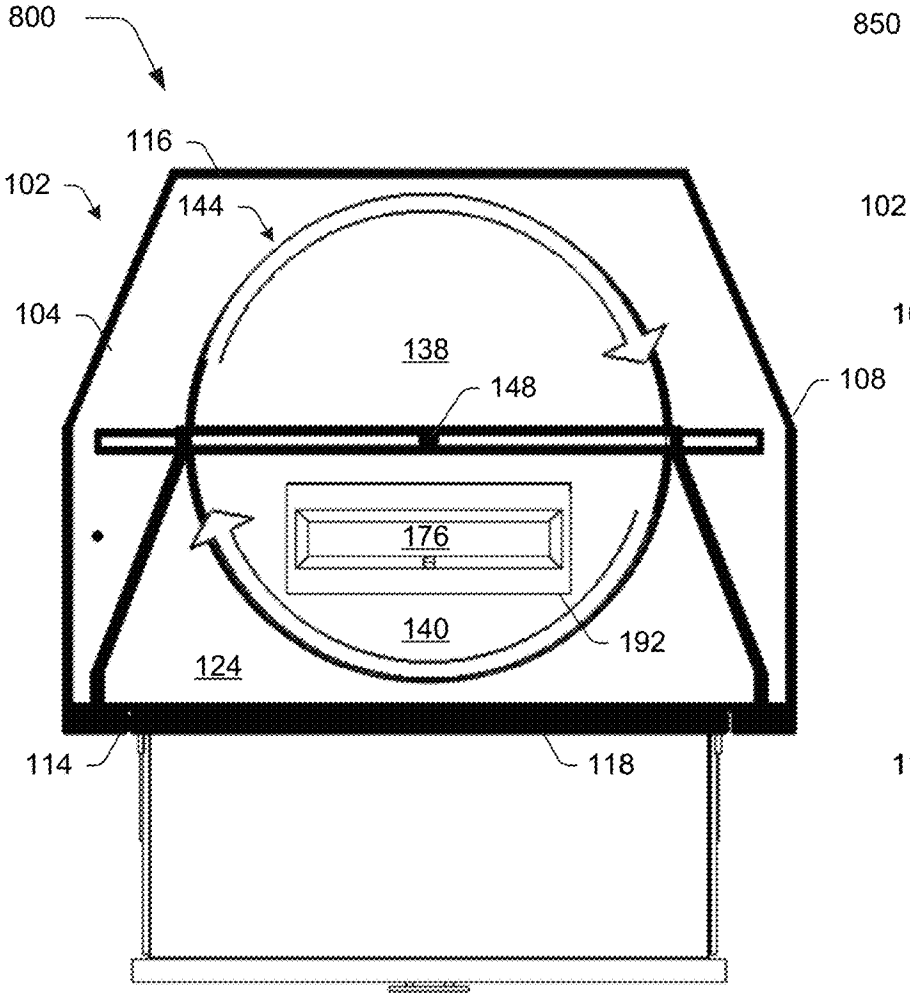

FIGS. 8A and 8B depict examples 800, 850 as shown from a top view of the carousel 144. As before, the carousel 144 includes a fire burning compartment 138 and a gas burning compartment 140. A floor of the gas burning compartment 140 includes an opening 192 such that, when the gas burning compartment 140 is viewable through the door 118, the opening 192 is positioned over the gas burner 176. This permits a flame from the gas burner 176 to project into the gas burning compartment 140. The wood burning compartment 138, on the other hand, has a solid floor and thus protects the gas burner 176 from contamination. In the example 800 of FIG. 8A, the gas burning compartment 140 is viewable through the door 118, whereas in the example 850 of FIG. 8B the wood burning compartment 138 is viewable through the door 118.

Figure 9:
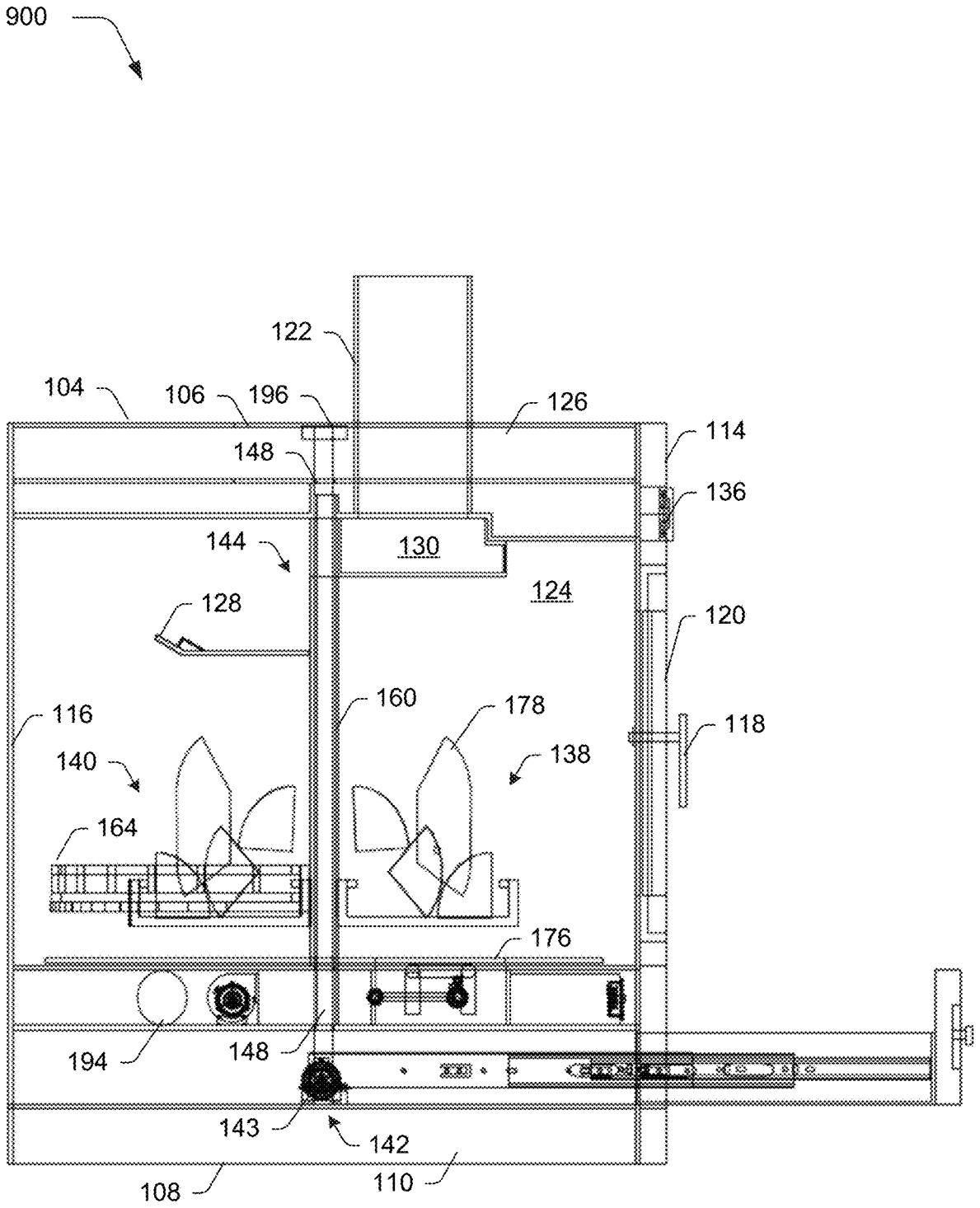
FIG. 9 depicts a side cut-away view of the fireplace apparatus of FIG. 7.

FIG. 9 depicts a side cut-away view of the carousel 144 as configured for horizontal rotation. As shown, the gas burner 176 remains fixed in this example. The objects 178 are mounted to the insulated wall 160 and thus move with the gas burning compartment 160. A motor 143 is included as part of the mechanism 142 to cause the rotational movement. An air intake port 194 is configured to intake air from outside a residence or commercial structure, in which, the fireplace apparatus 102 is disposed. The rack 164 includes a removable tray with detachable handles for easy cleaning. The spindle 148 is attached to the enclosure 104 via a shaft mounted bearing 196 and include a locking center cap with insulated fire proof seal.

FIGS. 10A, 10B, and 10C depicts examples 1000, 1020, 1040 of a view of a first opposing side 110, a top view, and a second opposing side 112, respectively.

Figure 11:
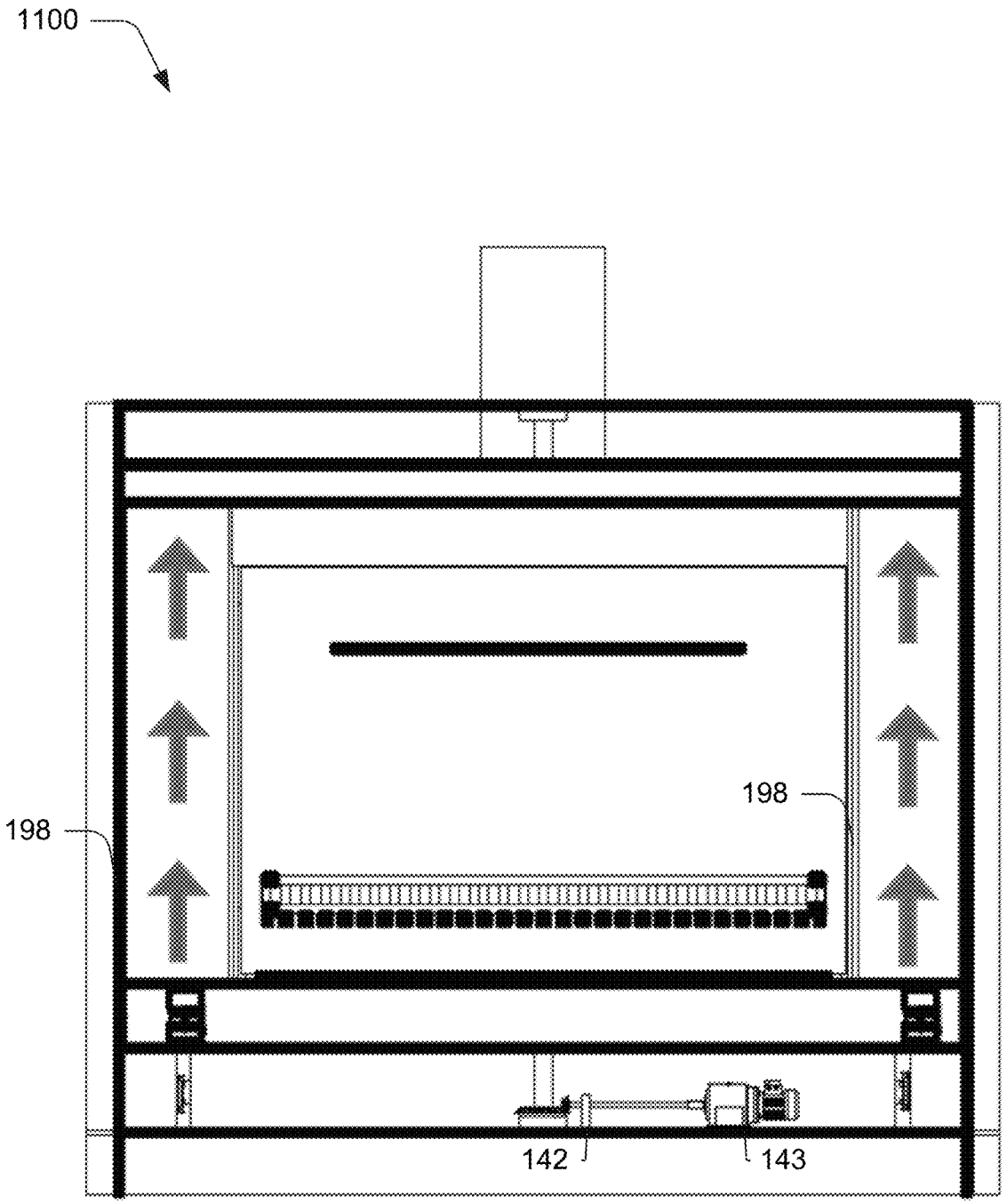
FIG. 11 depicts a cut-away view from a front of the fireplace apparatus of FIG. 7 showing venting.

FIG. 11 depicts an example 1100 showing air vent ducts 198 that are configured to vent air, e.g., through use of the convention fan 132. The mechanism 142 and motor 143 are configured to rotate the carousel as previously described. The rack 164 is configured to fold against a back wall of the wood burning compartment 138.

Fireplace Apparatus Having Translational Movement

Figure 12:
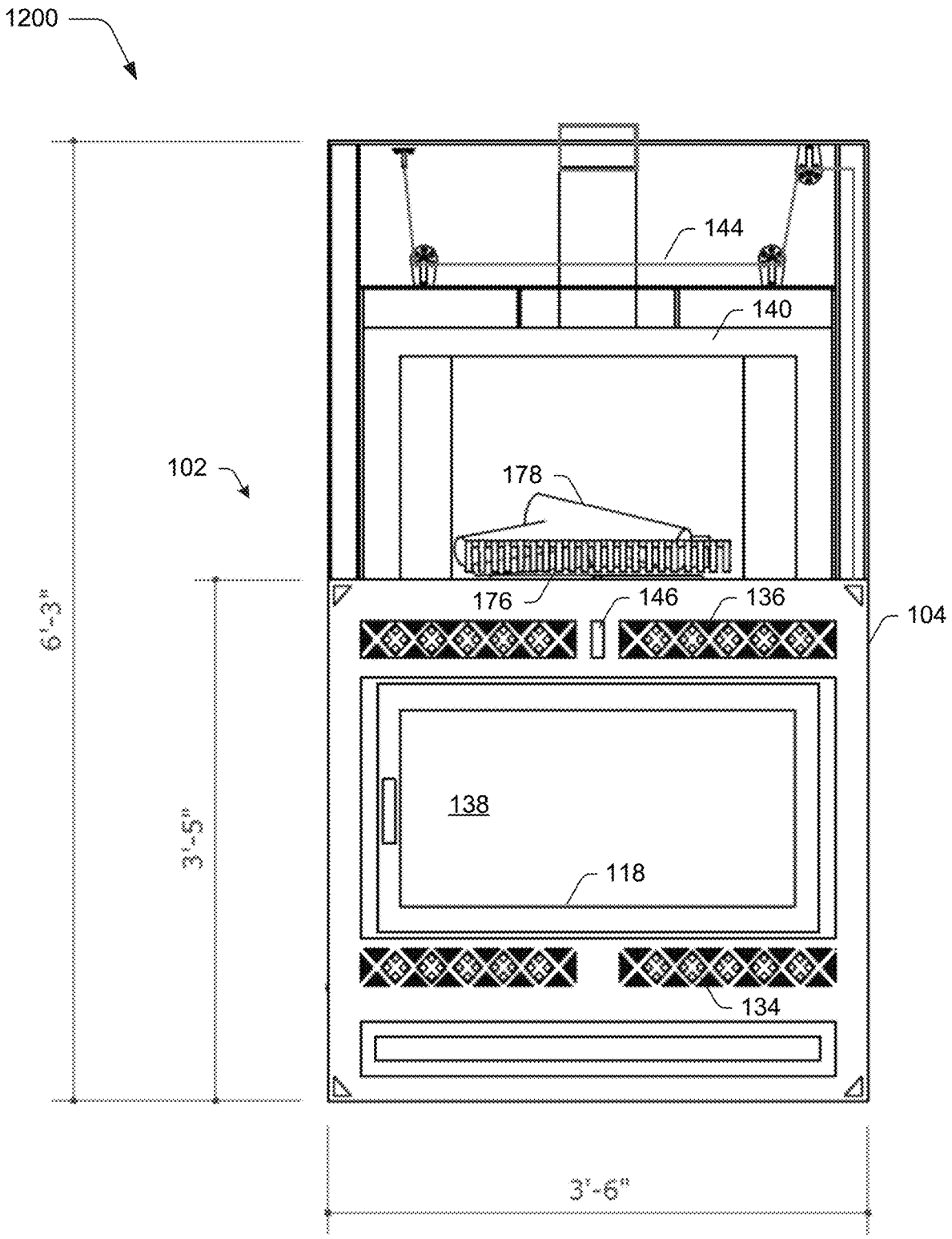
FIG. 12 depicts an example implementation in which the fireplace apparatus support translational rectilinear movement to support a wood burning mode and a gas burning mode.
Figure 13:
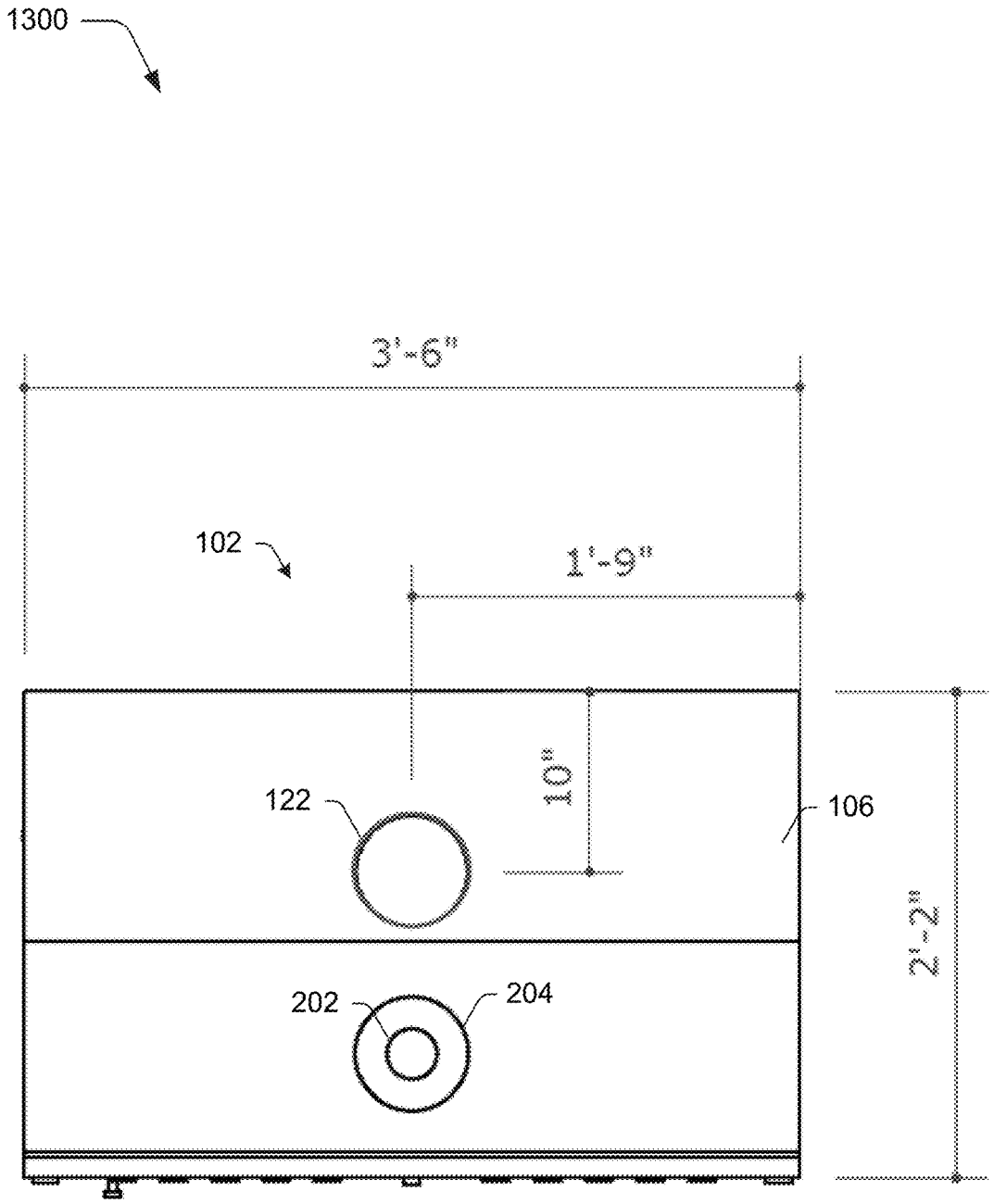
FIG. 13 depicts a top view of the fireplace apparatus of FIG. 12.
Figure 14:
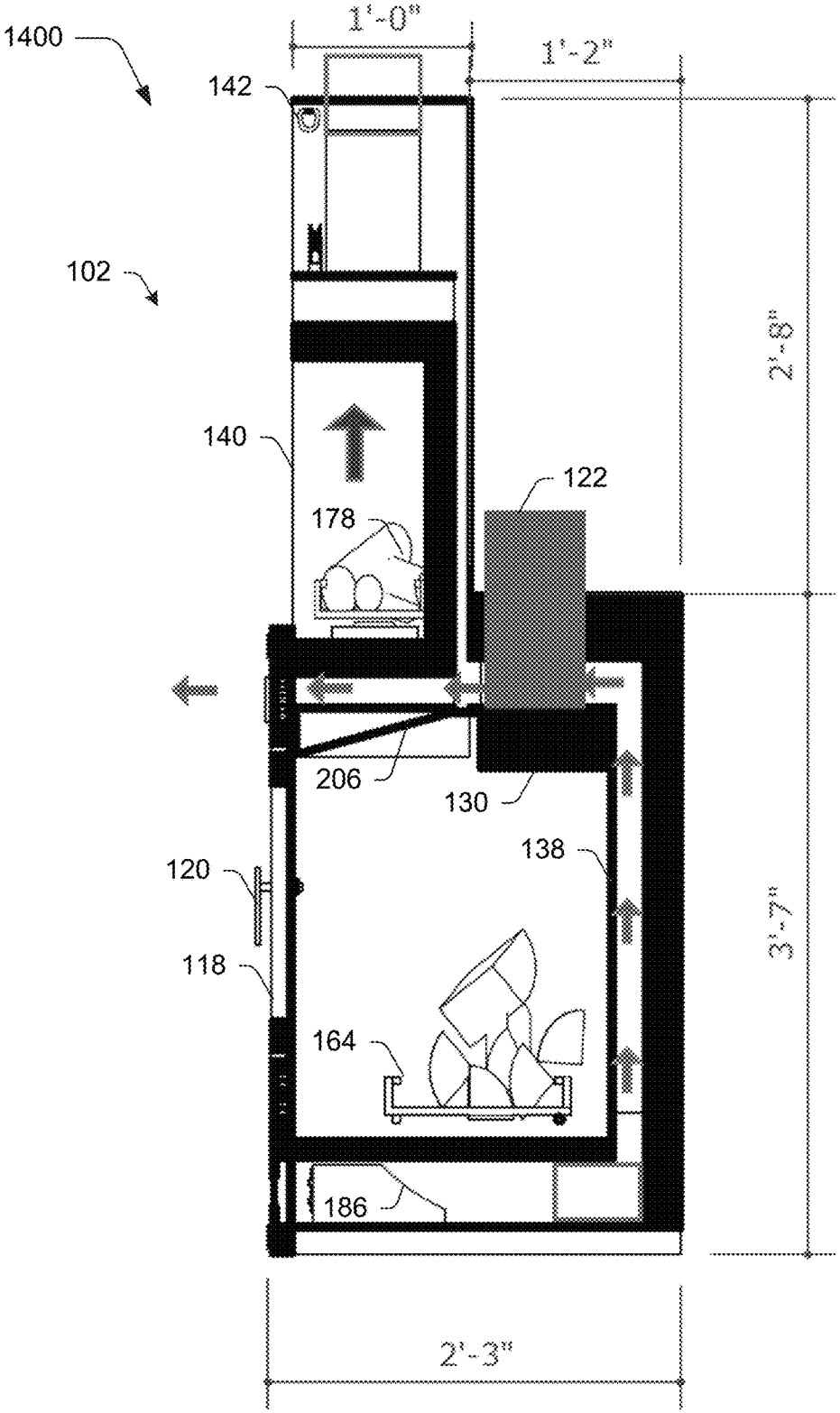
FIG. 14 depicts a side cut-away view of the fireplace apparatus of FIG. 12 in a wood burning mode.
Figure 15:
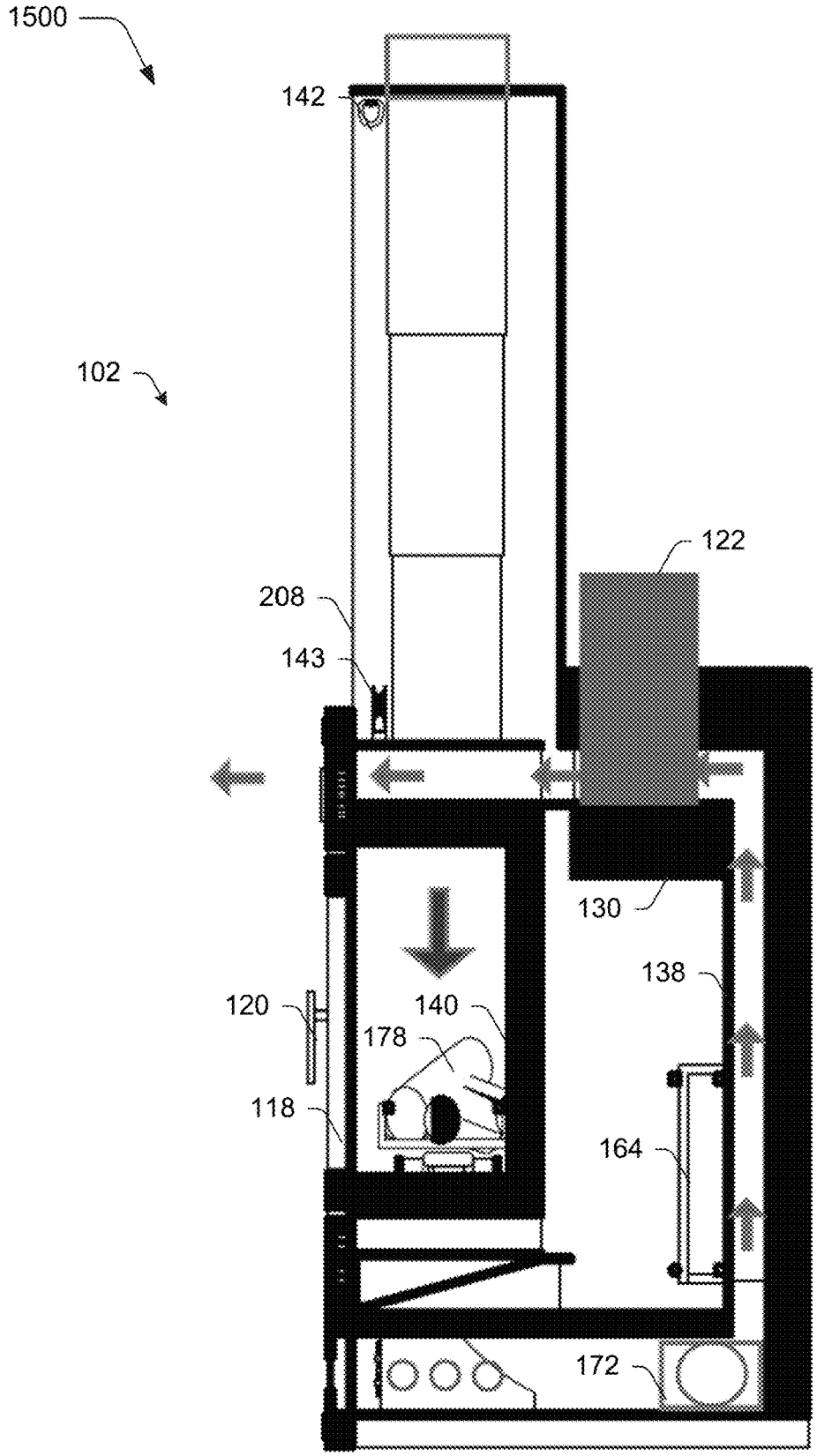
FIG. 15 depicts a side cut-away view of the fireplace apparatus of FIG. 12 in a gas burning mode.
Figure 16:
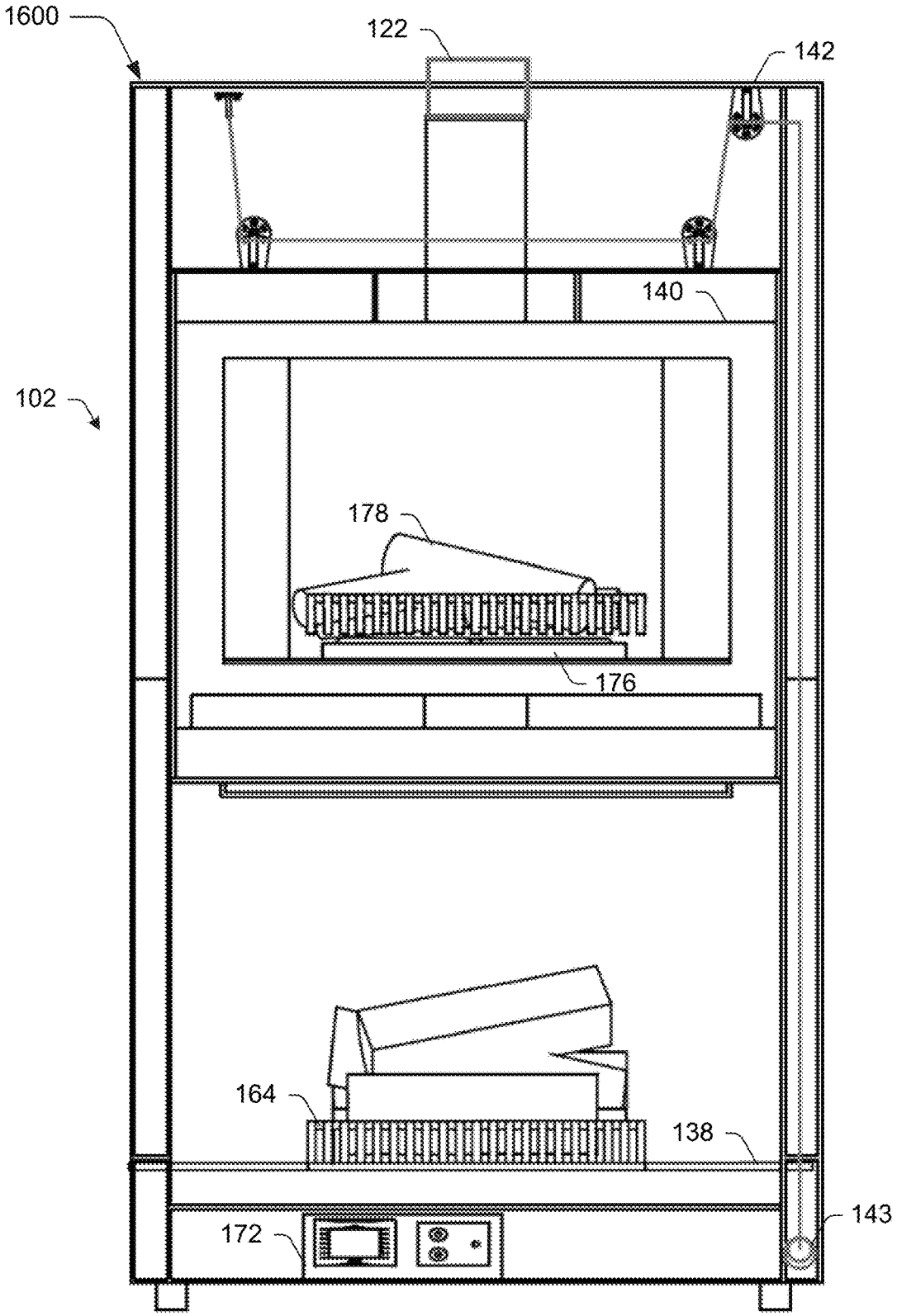
FIG. 16 depicts a front cut-away view of the fireplace apparatus of FIG. 12 in a wood burning mode.
Figure 17:
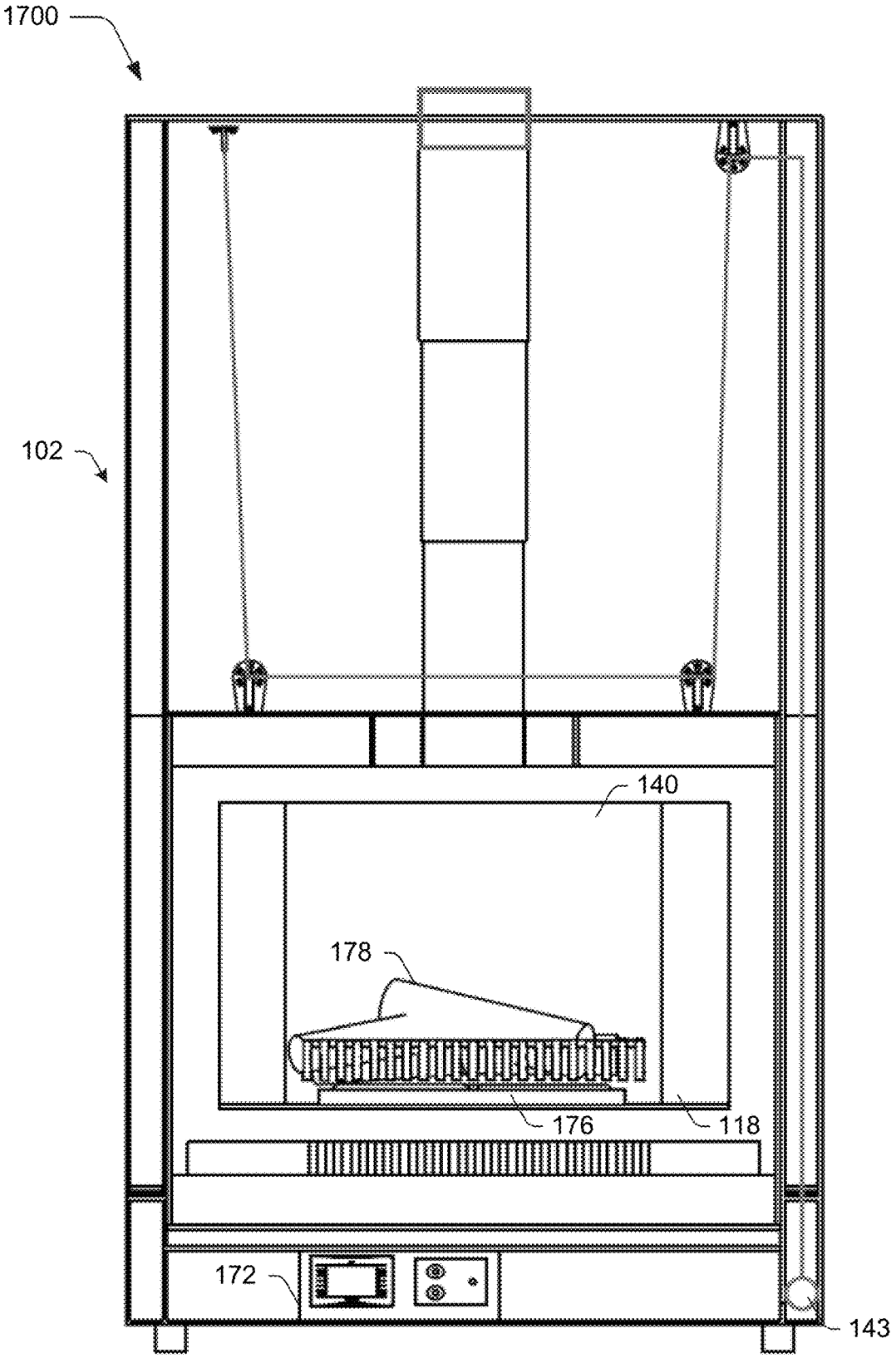
FIG. 17 depicts a front cut-away view of the fireplace apparatus of FIG. 12 in a gas burning mode.

FIGS. 12-17 depict examples 1200, 1300, 1400, 1500, 1700, 1700 in which the gas burning compartment 140 supports translational movement along an axis to be disposed within the wood burning compartment 138. In this way, the translation movement also supports a first mode in which the wood burning compartment 138 is viewable through the door 118 as shown in FIGS. 12, 14, and 16 and a second mode in which the gas burning compartment 140 is viewable through the door as shown in FIGS. 15 and 17. In these examples, the translation movement is along a vertical axis. Other examples are also contemplated, include horizontal movement, e.g., toward and away from the door 118.

FIG. 12 depicts a cut-away view of the fireplace apparatus 102. In this example, the enclosure 104 is configured to extend upward such that the gas burning compartment 140 is disposed above the wood burning compartment 138. The mechanism 142 and motor 143 in this example are configured as a cable and pulley system to raise and lower the gas burning compartment 140. Other examples of the mechanism 142 are also contemplated, include hydraulics.

As shown in FIG. 13, the wood burning compartment 138 includes an exhaust vent 122. An additional air intake 202 and exhaust vent 204 may also be used to the gas burning compartment and/or may share the exhaust vent 122.

In FIG. 14, the gas burning compartment includes a bottom plate 206 that is configured to direct combustion gases from the wood burning compartment 138 toward the catalytic combustor 130. As illustrated, the gas burning compartment 140 is configured to be disposed in a recess 208 within the enclosure 104 when the fireplace apparatus 102 is in a mode to burn wood in the wood burning compartment 138. To switch to a gas mode, the mechanism 142 lowers the gas burning compartment 140 such that it is disposed within the wood burning compartment 138. Thus, in this example the gas burning compartment 140 supports translational motion, which is rectilinear, to move between modes. Other examples are also contemplated.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. An apparatus comprising:

an enclosure having a door disposed thereon;

a wood burning compartment disposed within the enclosure, the wood burning compartment having an insulated housing configured to support temperatures associated with burning of wood within the wood burning compartment;

a gas burning compartment having a gas burner disposed therein; and a mechanism including a motor configured to cause movement between a first mode in which the wood burning compartment is viewable through the door and a second mode in which the gas burning compartment is viewable through the door, in which the movement is rotational movement about an axis that is substantially parallel to a base of the enclosure.

2. The apparatus as described in claim 1, wherein the rotational movement causes ashes formed in the wood burning compartment to be moved automatically and without user intervention into a collection area.

3. The apparatus as described in claim 2, wherein the collection area is configured as a drawer that is accessible via a front of the enclosure, onto which, the door is also disposed.

4. The apparatus as described in claim 1, wherein the movement is translational movement along an axis.

5. The apparatus as described in claim 1, wherein the first mode is configured such that the gas burning compartment is not viewable through the door.

6. The apparatus as described in claim 1, wherein the wood burning compartment has a rack configured to support wood logs having a length of at least six inches.

7. The apparatus as described in claim 1, wherein the wood burning compartment includes a rack that is configured as a rest for a cooking utensil to be disposed thereon while in proximity to a fire within the wood burning compartment.

8. The apparatus as described in claim 1, wherein the gas burning compartment has an object mounted thereto that is configured to be heated directly by a gas fire from the gas burner.

9. The apparatus as described in claim 1, further comprising a catalytic combuster configured to incinerate particulates or gases formed by a fire in the wood burning compartment and a fire in the gas burning compartment.

10. The apparatus as describe in claim 1, wherein the gas burning compartment is separated from the wood burning compartment by an insulated wall of the insulated housing.

11. The apparatus as described in claim 1, wherein the door includes a handle configured to mechanically lock to the enclosure.

12. An apparatus comprising:

an enclosure;

a door disposed on the enclosure;

a carousel mounted to the enclosure via a spindle to support rotational movement of the carousel within and in relation to the enclosure, the carousel including:

a wood burning compartment having an insulated housing configured to support temperatures associated with burning of wood within the wood burning compartment;

a gas burning compartment having a gas burner disposed therein;

a first gas line connected to the gas burner through the spindle to a rotating gas coupler to a second gas line having a gas shut off value; and a mechanism including a motor configured to cause movement of the carousel between a first mode in which the wood burning compartment is viewable through the door and a second mode in which the gas burning compailinent is viewable through the door.

13. The apparatus as described in claim 12, further comprising a convection fan configured to vent air from around the carousel out vents disposed in a front of the enclosure, onto which, the door is disposed.

14. The apparatus as described in claim 12, further comprising a bypass damper control configured to control opening and closing of a damper in relation to a vent pipe.

15. An apparatus comprising:

an enclosure;

a door disposed on the enclosure;

a carousel mounted to the enclosure via a spindle to support rotational movement of the carousel within and in relation to the enclosure, the carousel including:

a wood burning compartment having an insulated housing configured to support temperatures associated with burning of wood within the wood burning compartment; and a gas burning compartment having a gas burner disposed therein, the gas burning compartment separated from the wood burning compartment by an insulated wall, the wood burning compartment is formed on an opposing side of the insulated wall from the gas burning compartment; and a mechanism including a motor configured to cause the rotational movement of the carousel.

16. An apparatus comprising:

an enclosure having a door disposed thereon;

a wood burning compartment disposed within the enclosure, the wood burning compartment having an insulated housing configured to support temperatures associated with burning of wood within the wood burning compartment;

a gas burning compartment having a gas burner disposed therein; and a mechanism including a motor configured to cause movement between a first mode in which the wood burning compartment is viewable through the door and a second mode in which the gas burning compartment is viewable through the door, the movement is rotational movement about an axis causing ashes formed in the wood burning compartment to be moved automatically and without user intervention into a collection area.

17. The apparatus as described in claim 16, wherein the collection area is configured as a drawer that is accessible via a front of the enclosure, onto which, the door is also disposed.

18. An apparatus comprising:

an enclosure having a door disposed thereon;

a wood burning compartment disposed within the enclosure, the wood burning compartment having an insulated housing configured to support temperatures associated with burning of wood within the wood burning compartment;

a gas burning compartment having a gas burner disposed therein; and a mechanism including a motor configured to cause movement between a first mode in which the wood burning compartment is viewable through the door and a second mode in which the gas burning compartment is viewable through the door, the movement is translational movement along an axis.

19. An apparatus comprising:

an enclosure having a door disposed thereon;

a wood burning compartment disposed within the enclosure, the wood burning compartment having an insulated housing configured to support temperatures associated with burning of wood within the wood burning compartment;

a gas burning compartment having a gas burner disposed therein; and a mechanism including a motor configured to cause movement between:

a first mode in which the wood burning compartment is viewable through the door and the gas burning compartment is not viewable through the door; and a second mode in which the gas burning compartment is viewable through the door.

* * * * *